US005386608A

United States Patent [19]

Montabaur et al.

[11] Patent Number: 5,386,608

[45] Date of Patent: Feb. 7, 1995

[54] ROTARY BRUSH ASSEMBLY

[75] Inventors: Werner Montabaur, Königswinter; Detlef Thomas, Köln, both of Germany

[73] Assignee: Monti-Werkzeuge GmbH, Bonn, Germany

[21] Appl. No.: 19,554

[22] Filed: Feb. 19, 1993

[30] Foreign Application Priority Data

Feb. 21, 1992 [DE] Germany ..... 4205265

[51] Int. Cl.[6] ..... A46B 7/10; A46B 13/02

[52] U.S. Cl. ..... 15/179; 15/230.16; 451/466

[58] Field of Search ..... 15/179, 181, 230.16; 51/331, 332, 333, 334, 371

[56] References Cited

U.S. PATENT DOCUMENTS

| | | | |
|---|---|---|---|
| 376,800 | 1/1888 | Frisbie | 15/179 |
| 648,890 | 5/1900 | Williams | 51/334 |
| 4,455,788 | 6/1984 | Freerks | 51/334 |

FOREIGN PATENT DOCUMENTS

| | | | |
|---|---|---|---|
| 229334 | 12/1910 | Germany | 15/179 |

*Primary Examiner*—David A. Scherbel
*Assistant Examiner*—Randall E. Chin
*Attorney, Agent, or Firm*—Herbert Dubno; Andrew Wilford

[57] ABSTRACT

A brush assembly adapted to be rotated about an axis has a brush having a flexible, annular and generally cylindrical collar generally centered on the axis and having a predetermined and generally uniform radial thickness, a predetermined inside diameter, and a predetermined axial length, and a plurality of arrays of radially projecting bristles angularly equispaced about the collar and defining a plurality of axially throughgoing and angularly equispaced bristle-free zones. A holder for the brush has a core body having a plurality of surface portions radially equispaced from and angularly equispaced about the axis and lying substantially on a cylinder centered on the axis and having a predetermined outside diameter substantially smaller than the inside diameter of the collar, inner and outer end flanges axially flanking the core body and spaced axially apart by a predetermined axial distance longer than the axial length of the collar so that the collar is received with axial play between the flanges, and respective retaining tongues extending axially from one of the flanges toward the other flange in the bristle-free zones of the brush. The tongues have inner surfaces spaced radially outward from the cylinder of the core body by a radial spacing substantially greater than the radial thickness of the collar so that the collar is received with radial play between the surface portions and the tongues.

15 Claims, 6 Drawing Sheets

ROTARY BRUSH ASSEMBLY

FIELD OF THE INVENTION

The present invention relates to a rotary brush assembly. More particularly this invention concerns a two-part rotary brush.

BACKGROUND OF THE INVENTION

A standard rotary brush assembly has a flexible, annular and generally cylindrical collar generally centered on an axis and having a predetermined and generally uniform radial thickness, a predetermined inside diameter, and a predetermined axial length. A plurality of arrays of radially projecting bristles angularly equispaced about the collar define a plurality of axially throughgoing and angularly equispaced bristle-free zones. A holder for the brush is comprised of a pair of flange disks each formed with a circular groove of the same diameter as the brush collar, a central screw spindle extending between the disks, and axially projecting tongues radially outside the grooves and spaced to engage in the bristle-free zones of the brush. The axial ends of the collar are fitted in the grooves of the disks with the tongues positioned in the bristle-free zones, and the screw is tightened to clamp the brush in place. This assembly is structurally very stable so that when it is rotated the radial outer ends of the bristles can be counted on to lie on a cylinder centered on the rotation axis of the brush, and the tongues prevent the brush from coming loose even if stressed considerably.

While this arrangement is fairly effective, it is susceptible of improvement.

OBJECTS OF THE INVENTION

It is therefore an object of the present invention to provide an improved rotary brush assembly.

Another object is the provision of such an improved rotary brush assembly which is more effective than the prior-art systems and that is cheaper to manufacture.

SUMMARY OF THE INVENTION

A brush assembly adapted to be rotated about an axis according to the invention has a brush having a flexible, annular and generally cylindrical collar generally centered on the axis and having a predetermined and generally uniform radial thickness, a predetermined inside diameter, and a predetermined axial length, and a plurality of arrays of radially projecting bristles angularly equispaced about the collar and defining a plurality of axially throughgoing and angularly equispaced bristle-free zones. A holder for the brush has a core body having a plurality of surface portions radially equispaced from and angularly equispaced about the axis and lying substantially on a cylinder centered on the axis and having a predetermined outside diameter substantially smaller than the inside diameter of the collar, inner and outer end flanges axially flanking the core body, that is one on each axial side of the core body, and spaced axially apart by a predetermined axial distance longer than the axial length of the collar so that the collar is received with axial play between the flanges, and respective retaining tongues extending axially from one of the flanges toward the other flange in the bristle-free zones of the brush. The tongues have inner surfaces spaced radially outward from the cylinder of the core body by a radial spacing substantially greater than the radial thickness of the collar so that the collar is received with radial play between the surface portions and the tongues.

When such a brush is rotated it has been found that the brush collar bulges outward between the tongues, creating lobes that give the normally cylindrical outer surface of the brush a lobular shape that causes the bunches of bristles to strike the object being abraded in a pulsating or vibratory manner, unlike the continuous rubbing of the prior art. This vibration gives substantially greater abrasion, making the system of this invention much more effective than the prior-art systems.

According to another feature of this invention the core body is a cylindrical core tube having a cylindrical outer surface forming the surface portions. The inner end flange has flange portions unitarily formed with and extending radially from an axial end of the core tube and the retaining tongues are unitarily formed with and extending axially from radial outer ends of the flange portions. The outer end flange, that is the end flange axially further away from the drive unit on which the brush is mounted, can be formed with seats in which axial ends of the tongues are received and the tongues and flange portions are of the same angular width. The holder can be stamped or cast of metal or molded of a synthetic resin.

Furthermore in accordance with the invention the tongues have axially outer ends that are bent over to form part of the outer flange and that are seated in the outer flange. The core body can be formed by a pair of plates having axially oppositely bent outer peripheries forming the surface portions and having outwardly bent outer edges forming the flanges and in turn having inwardly bent ends forming the tongues. In this case the tongues can have inner ends that axially engage each other.

Furthermore according to the invention the flanges are disks formed with axially oppositely outwardly bent annular rims forming the surface portions and radially outwardly bent outer peripheries axially flanking the brush, one of the outer peripheries are unitarily formed with the tongues. Here the outer periphery of the other disk is formed with bayonet grooves releasably receiving ends of the tongues.

In another arrangement according to the invention the core body is formed by two identical disks having axially oppositely outwardly bent annular rims forming the surface portions and radially outwardly bent outer peripheries forming the flanges and in turn having radial outer edges formed with axially extending tongues that engage each other in a central plane of the holder. In most cases the holder is provided with an axially centered drive spindle.

It is also possible for the core body to be is of polygonal shape and have corners constituting the surface portions In this case the core body is axially clamped between the flanges. Alternately the core body can be a rigid tube that is radially movable between the flanges. Thus the core body can be axially clamped between the flanges or can have an axial length slightly less than an axial spacing between the flanges.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
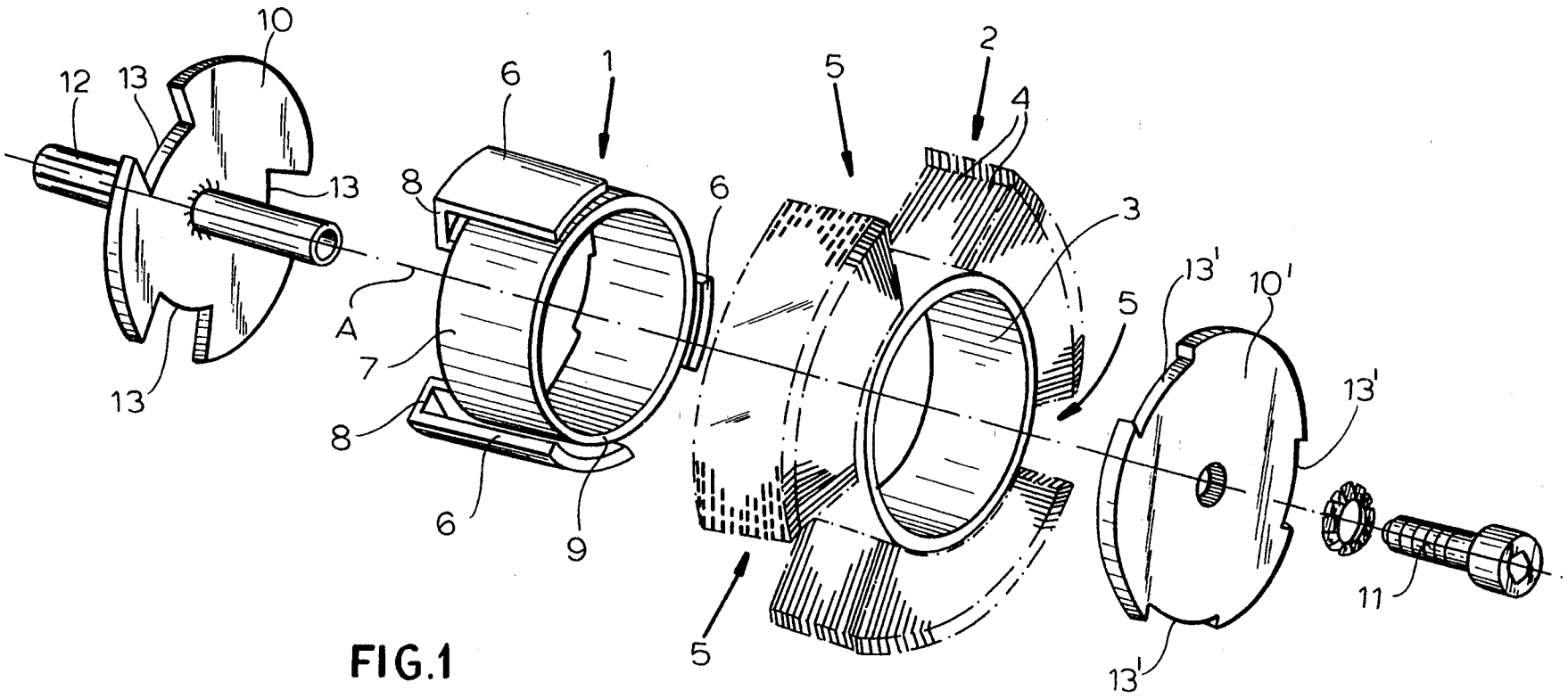
FIG. 1 is an exploded perspective view of a brush assembly according to the invention.

As seen in FIG. 1 a brush assembly according to the invention basically comprises a holder 1 and a brush 2, both centered on an axis A about which the assembly 1, 2 is rotated when in use. Both the holder 1 and brush 2 are symmetrical with respect to the axis A.

Figure 2:
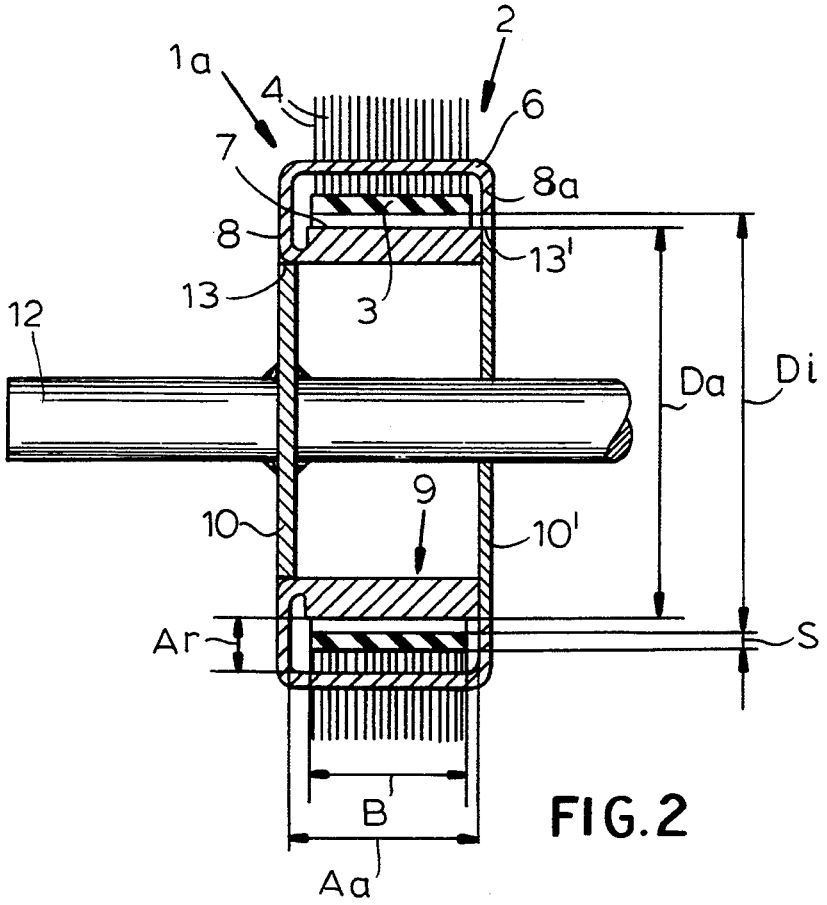
FIG. 2 is an axial section through a variant on the FIG. 1 brush.

The brush 2 comprises a cylindrical collar 3 of a flexible elastomer having as seen in FIG. 2 an inside diameter Di, a thickness S, and an axial length B. This collar 3 carries three bunches 4 of radially outwardly projecting identical bristles that are angularly equispaced about the axis A and separated by axially throughgoing bristle-free zones 5. The bristles can be of wire, a synthetic or natural material, or even of glass, depending on the application to which the brush is to be put. There may be more or less than three such bunches 4 of bristles, but the zones 5 are normally angularly equispaced.

The holder 1 of FIG. 1 comprises a rigid cylindrically tubular core 9 whose smooth cylindrical outer surface defines a cylinder 7 having as seen in FIG. 2 an outside diameter Da smaller than the diameter Di and an axial length Aa greater than the length B. The inner end of the holder 1 is formed by a plurality of flange portions 8 extending radially outwardly from the inner end of the core tube 9 and by an inner flange disk or plate 10 formed with cutouts or notches 13 complementarily receiving these portions 8. Respective retaining tongues 6 extend axially outward from the radial outer ends of the flange portions 8 and are of a length somewhat greater than the length Aa. These tongues 6 have inner surfaces that are spaced radially outward from the surface 7 by a distance Ar which is a multiple of the thickness S of the collar 3. The outer end of the holder is formed by another flange disk or plate 10′ having radially outwardly open notches or cutouts 13′ in which the outer ends of the tongues 6 sit.

A screw 11 has a head which bears on the outer flange disk 10′ and is threaded in a spindle or mandrel 12 fixed centrally in the disk 10 to clamp the two disks 10 and 10′ to the opposite axial ends of the core tube 9 so that they axially flank the collar 3. In this position the brush collar 3 is received with both axial and radial play in the cage formed between the flange disks 10 and between the surface 7 and the tongues 6.

The holder 1*a* of FIG. 2 is similar to that of FIG. 1, except that the tongues 6 have outer ends 8a that are bent inward to confine the brush 2. In addition here there is no screw 11.

Figure 3:
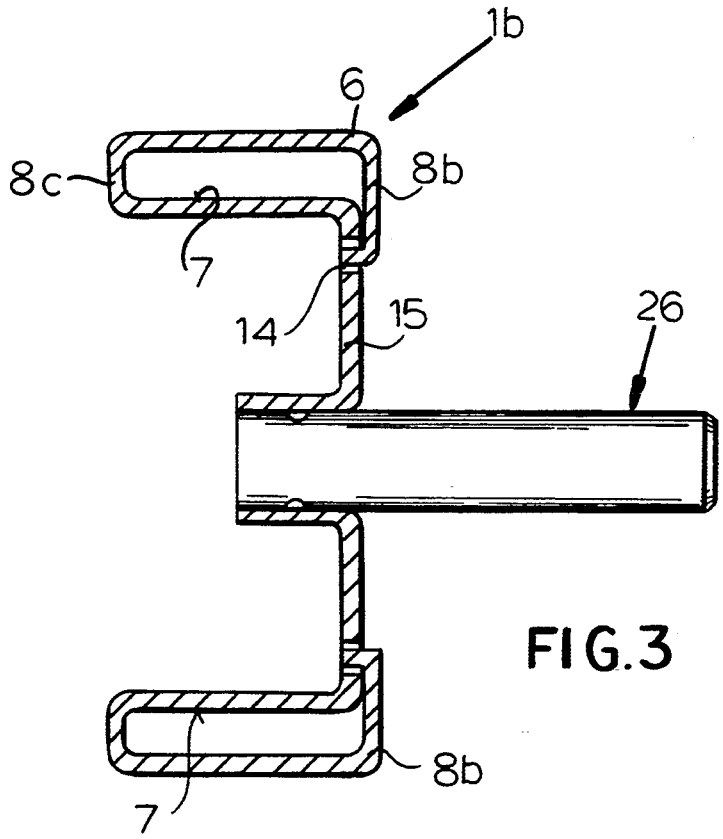
FIG. 3 is an axial section through a holder according to the invention.
Figure 4:
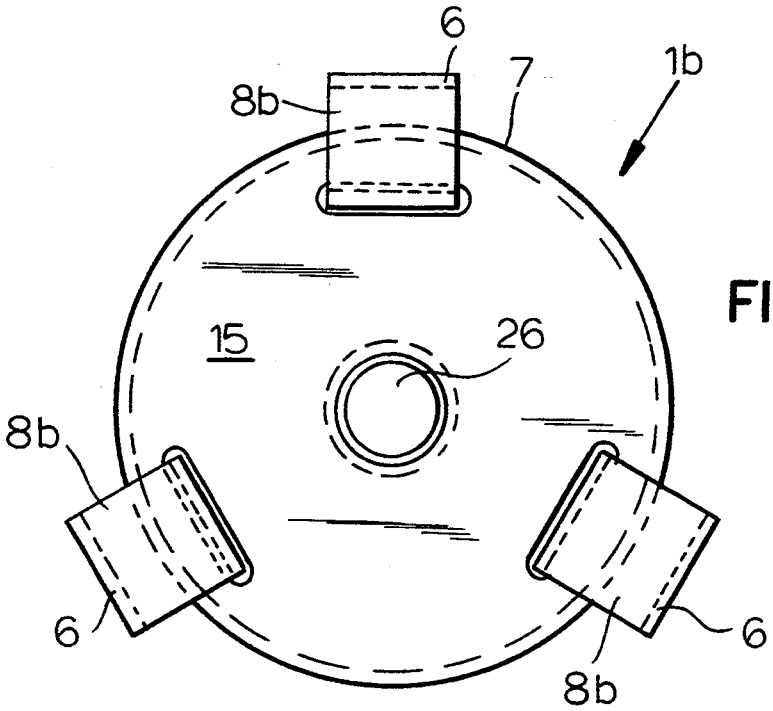
FIG. 4 is an axial end view of the holder of FIG. 3.

In FIGS. 3 and 4 a holder 1*b* is a stamped element formed unitarily as a central flat disk 15 with a bent-over edge that forms the cylindrical support surface 7 and whose outer end in turn is bent up to form an outer end flange 8*c*. The tongues 6 extend axially back from and indeed are formed unitary with the outer edge of the flange 8*c* and outer ends of the tongues 6 are bent down to form the inner flange 8*b*, with their ends tucked in slots 14 formed in the disk 15. An axially centered drive spindle 26 is seated in the disk 15. This assembly is fairly cheap to manufacture. The ends 8*b* are bent down after the brush 2 is fitted between the tongues 6 and surface 7.

Figure 5:
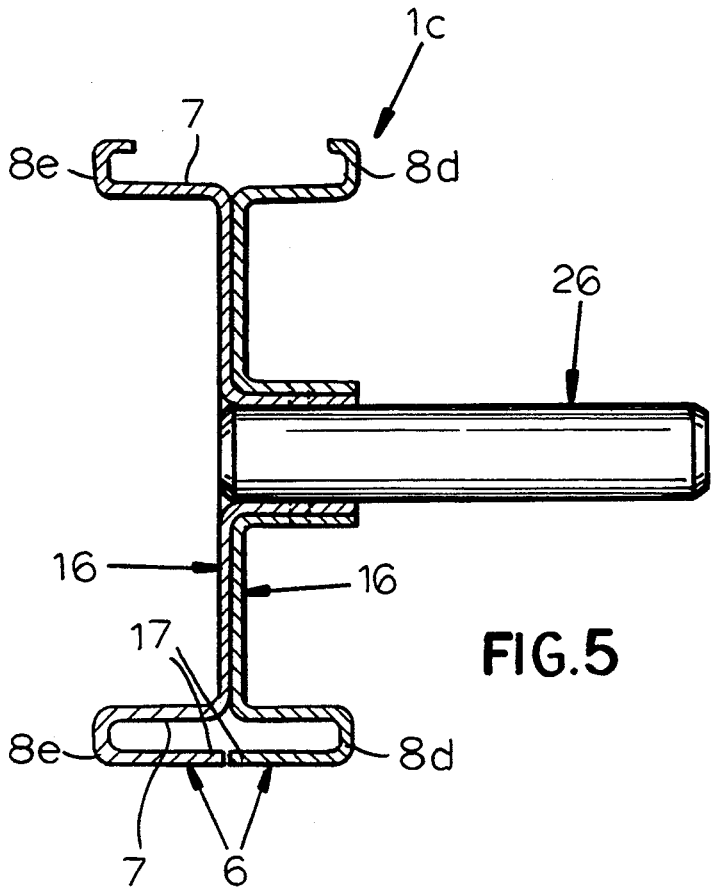
FIGS. 5 and 6 are views like respective FIGS. 3 and 4 of another holder in accordance with this invention.
Figure 6:
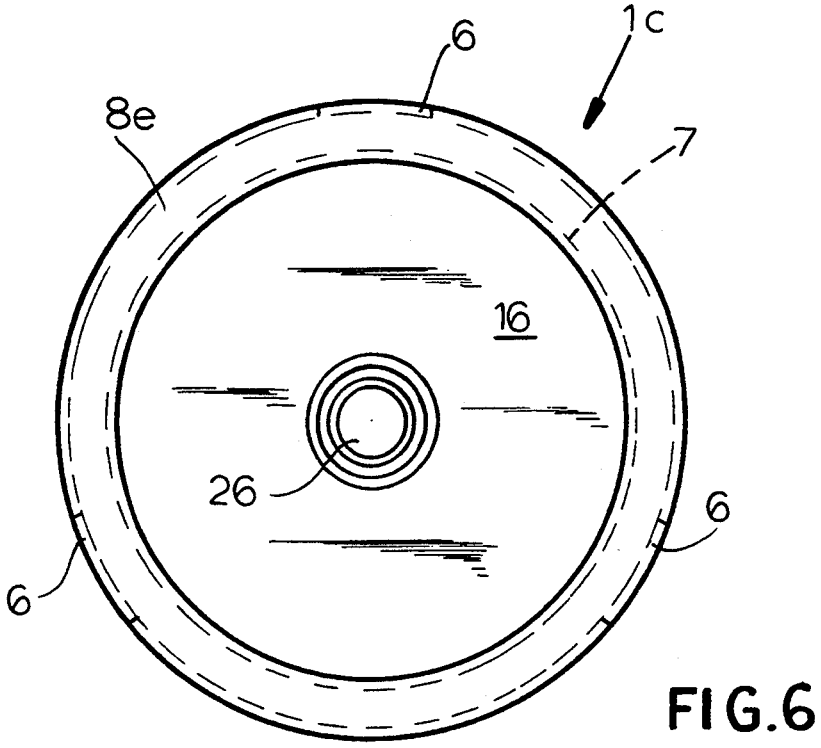

The holder 1*c* of FIGS. 5 and 6 is formed of two stamped metal plates 16 whose outer edges are bent cylindrically away from each other to form the surface 7 and then radially outward to form end flanges 8*d* and 8*e*. The tongues 6 once again extend from the outer peripheries of the flanges 8*d* and 8*e* toward each other and have ends 17 that meet centrally at the contact plane between the two disks 16.

Figure 7:
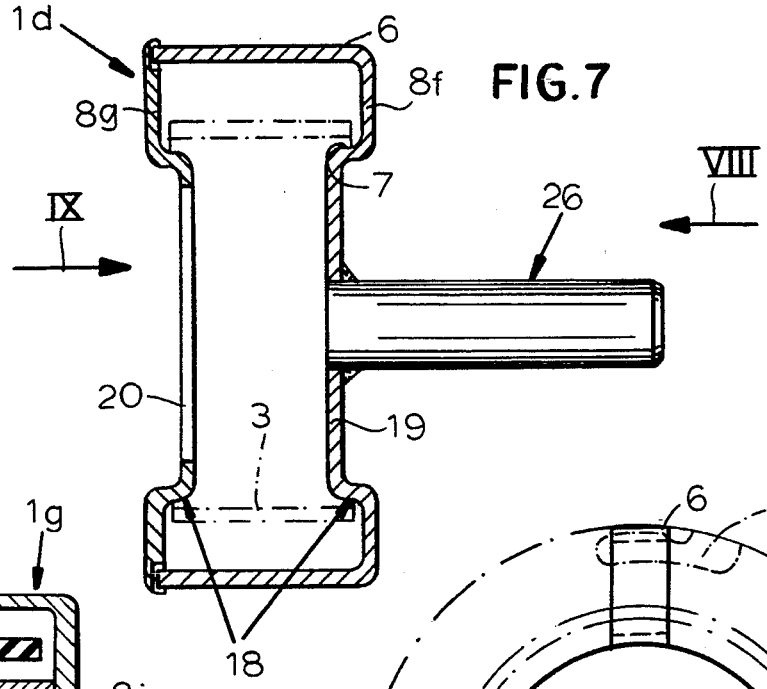
FIG. 7 is an axial section through yet another holder according to the invention.
Figure 8:
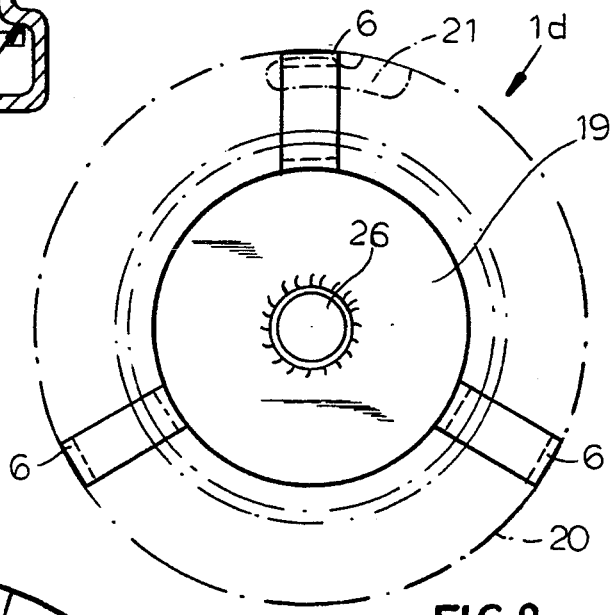
FIG. 8 is an end view taken in the direction of arrow VIII of FIG. 7.
Figure 9:
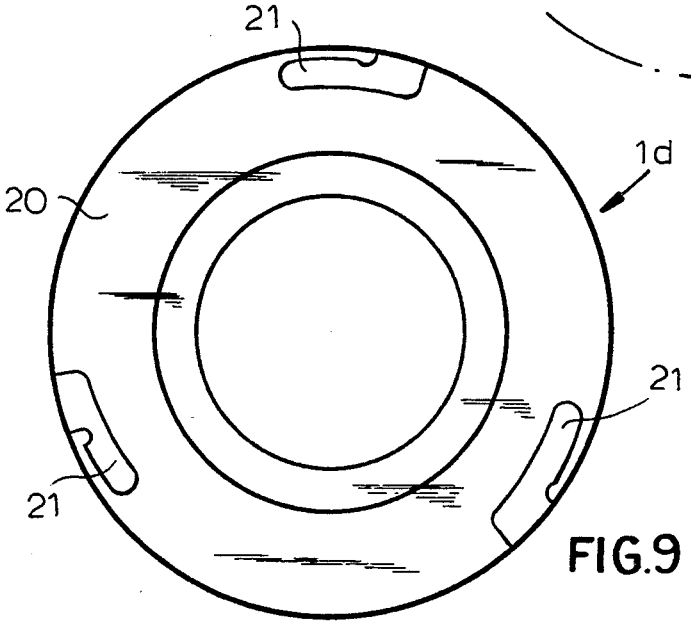
FIG. 9 is an end view taken in the direction of arrow IX of FIG. 7 but showing only the outer end flange.

The holder 1*d* of FIGS. 7 through 9 can have its brush, whose collar 3 is shown in dot-dash lines, changed relatively easily. Here a pair of plates 19 and 20 are flanged outward at 18 to form the support surface 7 and then outward in their planes to form flange plates 8*f* and 8*g*. The flange 8*f* is formed with the retaining tongues 6 and the flange 8*g* is formed with J-shaped slots 21 that receive the ends of the tongues 6 in a bayonet fit. Thus the plate 20 can be twisted and separated from the plate 19 to change the brush, whereupon the plate 20 can be set back in place and twisted in the opposite direction to lock it.

Figure 10:
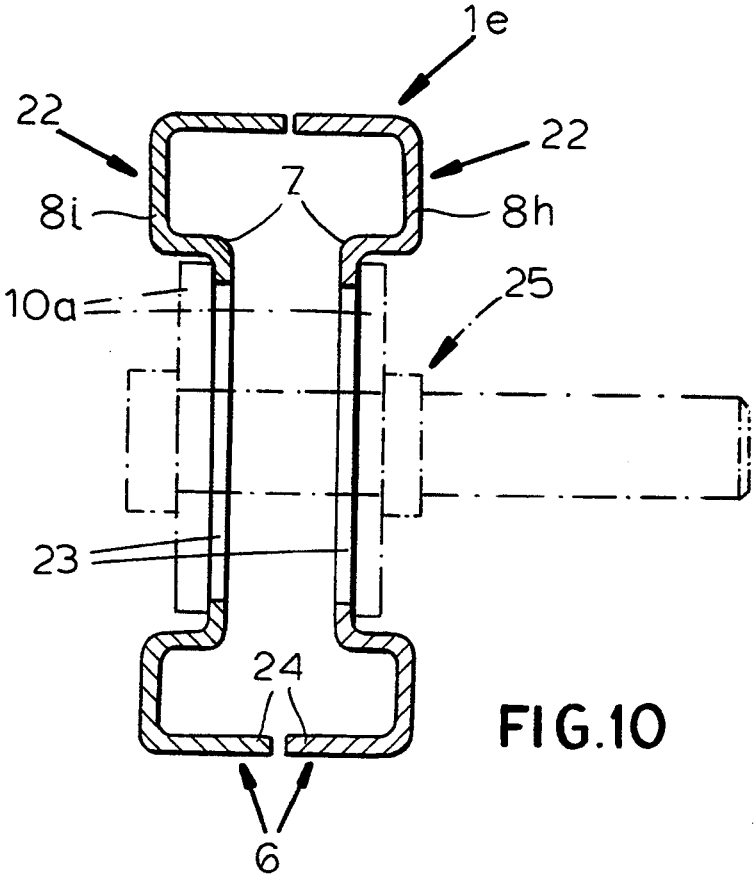
FIGS. 10 and 11 are views like respective FIGS. 3 and 4 of a further holder according to the invention.
Figure 11:
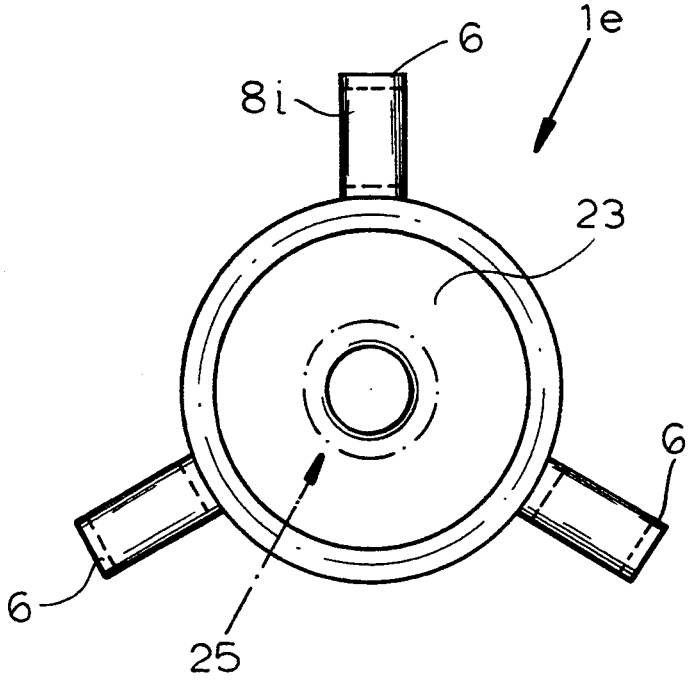

In FIGS. 10 and 11 a pair of identical plates 22 of a holder 1*e* are bent out like the plates 19 and 20 to form the surface 7 and then outward to form flange tongues 8*h* and 8*i* that are bent inward to form retaining tongues 6. Two plates 10a secured together by a threaded mandrel spindle 25 engage the two plates 22 together at their edges 24.

Figure 12:
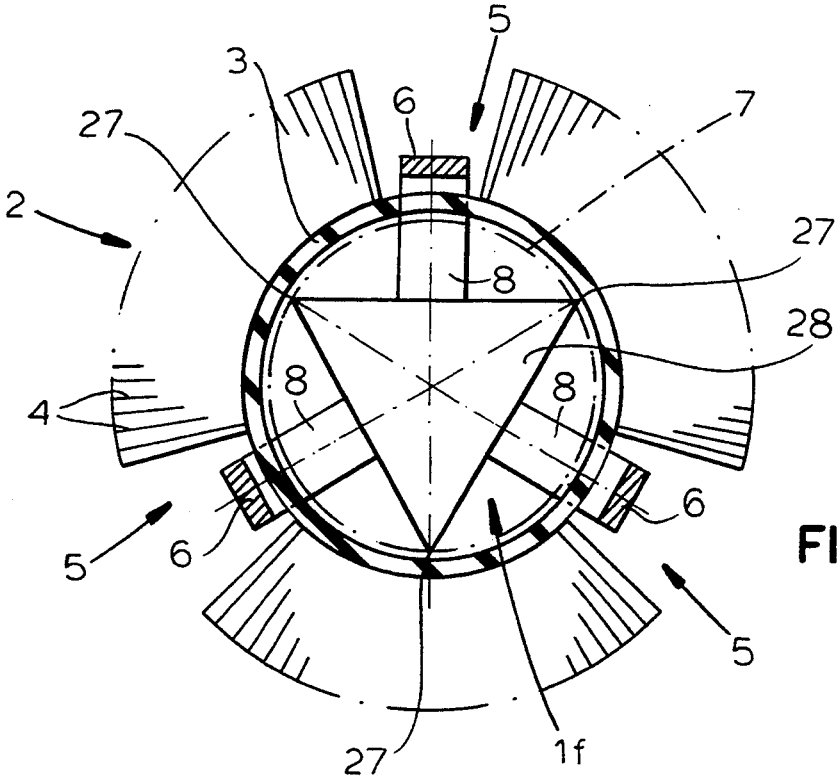
FIG. 12 is a partly sectional end view of yet another brush according to the invention.

The system of FIG. 12 has a triangular body 28 of a holder 1*f* whose corners 27 form the cylindrical support surface 7 that supports the brush collar 3. This body 28 could be of other polygonal shape and the corners 27 could be rounded.

Figure 13:
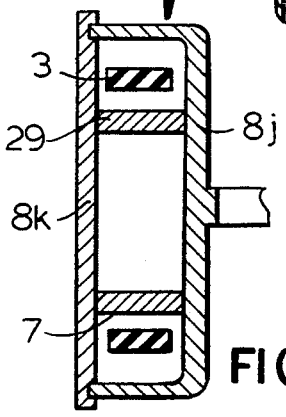
FIG. 13 is a small-sectional axial section through another brush according to the invention.

In FIG. 13, two flat flange plates 8*j* and 8*k* of a holder 1*g* flank an unattached core element 29 forming the surface 7. The flange plate 8*j* is formed with the fingers 6 that fit into J-grooves in the plate 8*k* as in FIG. 7. Here the core element 29 can move radially in the space between the flanges 8*j* and 8*i* and is of a length substantially equal to the spacing between them.

We claim:

1. A brush assembly adapted to be rotated about an axis, the assembly comprising:

a brush having a flexible, annular and generally cylindrical collar generally centered on the axis and having a predetermined and generally uniform radial thickness, a predetermined inside diameter, and a predetermined axial length, and a plurality of arrays of radially projecting bristles fixed in and angularly equispaced about the collar and defining a plurality of axially throughgoing and angularly equispaced bristle-free zones; and a holder having a core body defining a plurality of surface portions radially equispaced from and angularly equispaced about the axis and in turn defining a cylinder centered on the axis and having a predetermined outside diameter substantially smaller than the inside diameter of the collar, axially spaced inner and outer end flanges axially flanking the core body and spaced axially apart by a predetermined axial distance longer than the axial length of the collar, whereby the collar can be received with axial play between the flanges, and a respective retaining tongue extending axially from one of the flanges toward the other flange in each of the bristle-free zones of the brush, the tongues having radially inwardly directed inner surfaces spaced radially outward from the cylinder of the core body by a radial spacing substantially greater than the radial thickness of the collar, whereby the collar can be received with radial play between the surface portions and the tongues.

2. The rotary brush defined in claim 1 wherein the core body is a cylindrical core tube having a cylindrical radially outwardly directed outer surface forming the surface portions, the inner end flange having flange portions unitarily formed with and extending radially from an axial end of the core tube and the retaining tongues being unitarily formed with and extending axially from radial outer ends of the flange portions.

3. The rotary brush defined in claim 2 wherein the outer end flange is formed with seats in which axial ends of the tongues are received.

4. The rotary brush defined in claim 2 wherein the tongues and flange portions are of the same width.

5. The rotary brush defined in claim 2 wherein the tongues have axially outer ends that are bent over to form part of the outer flange and that are seated in the outer flange.

6. The rotary brush defined in claim 1 wherein the core body is formed by a pair of plates having axially oppositely bent radially outer peripheries forming the surface portions and having radially outwardly bent outer edges forming the flanges and in turn having axially inwardly bent ends forming the tongues.

7. The rotary brush defined in claim 6 wherein the tongues have axially confronting inner ends that axially engage each other.

8. The rotary brush defined in claim 1 wherein the flanges are disks formed with axially oppositely outwardly bent annular rims forming the surface portions and radially outwardly bent outer peripheries axially flanking the brush, one of the outer peripheries being unitarily formed with the tongues.

9. The rotary brush defined in claim 8 wherein the outer periphery of the other disk is formed with bayonet grooves releasably receiving ends of the tongues.

10. The rotary brush defined in claim 1 wherein the core body is centered on a central plane and is formed by two identical disks having axially oppositely outwardly bent annular rims forming the surface portions and radially outwardly bent radial outer peripheries forming the flanges and in turn having radial outer edges formed with axially extending tongues that engage each other in the central plane of the holder.

11. The rotary brush defined in claim 1 wherein the holder is provided with an axially centered drive spindle.

12. The rotary brush defined in claim 1 wherein the core body is of polygonal shape and has corners constituting the surface portions, the core body being axially clamped between the flanges.

13. The rotary brush defined in claim 1 wherein the core body is a rigid tube that is radially movable between the flanges.

14. The rotary brush defined in claim 1 wherein the core body is axially clamped between the flanges.

15. The rotary brush defined in claim 1 wherein the collar has an axial length slightly less than the axial distance between the flanges.

* * * * *